US006474983B1

(12) United States Patent
Robbins

(10) Patent No.: US 6,474,983 B1
(45) Date of Patent: Nov. 5, 2002

(54) HEATED INDUSTRIAL CURTAIN

(76) Inventor: Edward S. Robbins, 128 Hazelwood La., Florence, AL (US) 35630

( * ) Notice: Subject to any disclaimer, the term of this patent is extended or adjusted under 35 U.S.C. 154(b) by 0 days.

(21) Appl. No.: 09/845,928

(22) Filed: Apr. 30, 2001

(51) Int. Cl.[7] ..... F24F 9/00
(52) U.S. Cl. ..... 432/64; 160/330; 160/332
(58) Field of Search ..... 432/64; 160/184, 160/328, 330, 332

(56) References Cited

U.S. PATENT DOCUMENTS

| | | | | |
|---|---|---|---|---|
| 2,122,532 A | | 7/1938 | Mims et al. | |
| 4,095,642 A | | 6/1977 | McKinnon et al. | |
| 4,086,950 A | | 5/1978 | Power | |
| 4,165,778 A | | 8/1979 | Smith | |
| 4,232,725 A | | 11/1980 | Gidge | |
| 4,288,992 A | | 9/1981 | Eliason | |
| 4,289,190 A | | 9/1981 | Catan | |
| 4,304,174 A | * | 12/1981 | Hickson et al. | 160/330 |
| 4,355,678 A | | 10/1982 | Romano | |
| 4,367,781 A | | 1/1983 | Vallieres, Jr. et al. | |
| D269,576 S | | 7/1983 | Robbins, Jr. | |
| 4,400,046 A | | 8/1983 | Karashima | |
| 4,516,482 A | * | 5/1985 | Smith | 160/332 |
| 4,607,678 A | | 8/1986 | Pomaville et al. | |
| 4,855,567 A | | 8/1989 | Mueller | |
| 4,950,869 A | | 8/1990 | Mueller | |
| 5,203,175 A | | 4/1993 | Farrey et al. | |
| 5,310,338 A | * | 5/1994 | Harding | 432/64 |

* cited by examiner

*Primary Examiner*—Gregory Wilson
(74) *Attorney, Agent, or Firm*—Brinks Hofer Gilson & Lione

(57) ABSTRACT

A substantially transparent thermal barrier for use in an opening between a refrigerated area and an adjacent area having a significantly higher temperature is suspended by its upper margin from a header. The barrier is formed of a plurality of strips positioned adjacent to each other, each strip including at least two sheets of substantially transparent material fixed to each other so as to define a plurality of channels extending from the upper end to the lower end of each strip, with at least the upper ends of the channels being open. The header directs a flow of warmed and/or dried air into the upper end of the plurality of channels, the air preferably being taken from the colder of the two adjacent areas separated by the curtain. The air is warmed to a temperature about midway between the temperatures of the two areas separated by the curtain. As the air proceeds downward through the length of the channels, the air generally does not significantly change its temperature, and as a result, the warmed air flowing downward through the channels is delivered at the lower end of the strip at the same temperature as at the top of the strip. With the lower ends of the channels open, the air is delivered substantially at floor level immediately below the curtain and generally uniformly across the width of the opening in which the curtain is positioned. The air can be re-circulated by having closed bottom ends of the channels that communicate with return ducts leading back toward the header.

28 Claims, 3 Drawing Sheets

HEATED INDUSTRIAL CURTAIN

BACKGROUND OF THE INVENTION

The present invention relates generally to industrial curtains used as environmental closures for openings through which traffic can still pass. The curtains generally comprise a plurality of strips suspended contiguously to each other from a hanger fixed adjacent to a top margin of the opening, each strip consisting essentially of a length of flexible material terminating adjacent to a lower margin of the opening. The present invention relates particularly to an improved configuration for the material forming the strips of such industrial curtains so that vision through the curtain is improved in situations involving significant differences in environmental temperature on opposite sides of the curtain, and to a structure for suspending the strips.

Goods are often required to be transported from one area of a manufacturing or storage facility to another, where one of the areas is heated or ambient while the adjacent area is air-conditioned or even refrigerated. Where the traffic is only occasional, conventional doors can be employed to close any doorway between the two areas. Where the traffic is considerable, the use of conventional doors gives way to suspended flexible screens or curtains that inhibit the wholesale transfer of heated or refrigerated air from one area to the other yet still permit goods-transporting vehicles and personnel to pass through with little effort. Early screens were sometimes made of rubber as shown, for example, in U.S. Pat. No. 2,122,532. For safety reasons, it is desirable that the curtain be sufficiently transparent that one operating a transporting vehicle be able to see any hazard or obstruction that might exist on an opposite side of a screen before proceeding through. Persons on the opposite side of a screen also desire to be able to see oncoming transport vehicles so appropriate evasive action can be taken. Thus, plastic materials, which were more or less transparent, such as polyvinyl chloride and polyethylene, were adopted as the preferred materials for such screens as shown, for example, in U.S. Pat. Nos. 4,095,642; 4,165,778; 4,232,725; 4,367,781; and 4,607,678.

In situations involving significant differences in environmental temperature on opposite sides of the curtain, the large temperature difference often causes the humidity in the air, generally on the warmer side of the curtain, to condense on the surface of the curtain. If the temperature on the cooler side of the curtain is sufficiently low, the accumulating condensation turns to frost or even ice. The resulting condensation, whether or not frozen, contributes to a significant loss in visibility through the screen that results in a corresponding increase in hazard for transport vehicle operators and others alike. The condensation is often observed to drip off the lower end of the curtain and pool on the floor in the doorway. The pool of water, or ice if the area is sufficiently cold, constitutes an added hazard that would be desirable to avoid, if possible.

In an effort to diminish the likelihood of condensation or frost development, several designs for curtains and associated structures have been suggested by the prior art. The perimeter of a doorway may be kept free from frost by embedding a heater in the form of an electrical resistance unit in a doorway edge as disclosed in U.S. Pat. No. 4,855,567. Attempts at reducing the frost or condensation on a door or curtain have included the use of radiant heat as shown in U.S. Pat. No. 4,950,869 and warmed air blowers as shown in U.S. Pat. Nos. 4,288,992; 4,400,046; and 5,203,175. None of the systems have proven to be entirely satisfactory. The electrical resistance units may perform satisfactorily for a frame surrounding a doorway, but do not measurably affect the presence of frost or condensation on a door or curtain in the same doorway. The radiant heaters are observed to deliver heat unevenly, with the portion of the door or curtain closest to the heater receiving too much heat, and the portion farthest away receiving too little heat. Air convection currents generally prevent warmed air blowers, positioned at either the top or sides of a doorway, from delivering a sufficient amount of air to the bottom-central portion of a door or curtain to achieve the desired effect without resorting to very high-power blower units.

There is therefore a continuing need for alternative mechanisms for achieving a frost- and condensation-free industrial curtain while consuming as little power as possible. Preferably, the alternative mechanisms would also minimize or prevent any pooling of water at the base of the curtain, thereby avoiding that added hazard.

SUMMARY OF THE INVENTION

In accordance with the present invention, a substantially transparent thermal barrier is positioned for use in an opening between a refrigerated area and an adjacent area having a significantly higher temperature. The thermal barrier is suspended in the opening by its upper margin, where it is connected to a header. The barrier comprises a plurality of strips positioned adjacent to each other so as to present a substantially continuous barrier between the two areas on either side of the opening. Each of the strips has an upper and a lower end, the upper end being supported by the header. Each strip can include at least two sheets of substantially transparent material fixed to each other so as to define a plurality of channels extending from the upper end to the lower end of each strip, with at least the upper ends of the channels being open. Alternatively, each strip can be viewed to comprise a plurality of vertical tubes or conduits connected laterally to each other, with at least the upper ends of each tube being open. The header includes means for directing a flow of air into the open upper ends and then downward through the plurality of channels, conduits or tubes of each of the strips. The cross-sectional shape of the tubes, conduits or channels can be varied, and can be seen to form ducts for conducting the air downward from the header. The ducts generally will have open lower ends permitting escape of the flow of air, but can have closed lower ends that include lateral openings to adjacent ducts for conducting the air upward toward the header.

The air to be introduced into the open upper ends of the ducts should contain as little moisture as possible so that no condensation takes place within the ducts. For example, air is preferably taken from the colder of the two adjacent areas separated by the curtain since the air in that area, being colder, is likely to have less retained moisture. Prior to being introduced into the ducts in the curtain, the air is preferably heated to a temperature that is at least about midway between the temperatures of the two areas separated by the curtain. Air that has a temperature that is at least about midway between the temperatures of the two areas separated by the curtain is hereby defined as warmed air. To achieve this limited heating, thermostatic sensors can be positioned in each of the areas separated by the curtain to sense the temperature in each area. The thermostatic sensors can be connected to the heater by an appropriate control that prevents overheating of the air, which would be a waste of energy. As the warmed air proceeds downward through the length of the ducts, the air does not significantly change its temperature. As a result, the warmed air flowing downward through the ducts is delivered substantially at floor level.

If the ducts have open lower ends, the warmed air flowing downward through the ducts is delivered immediately below the curtain and generally uniformly across the width of the opening in which the curtain is positioned. The warmed air in the ducts generally maintains the surface of the curtain confronting the warmer area at a higher temperature that would be the case without the downward flow of air, thus inhibiting the formation of condensation or frost on the curtain surface. Additionally, the natural convection currents now cause the warmed air to flow upward on either side of the curtain, this air flow forming a moving blanket that additionally inhibits the formation of condensation or frost on the curtain surface. The same effect could be achieved by introducing air from which substantially all the moisture had been removed, herein defined as dried air. The warmed air and dried air are referred to herein as conditioned air.

It will be appreciated that the downward flow of conditioned air can be captured by means enabling the return of this air to the plenum. This use of return air has the advantage of lowering the amount of energy used in conditioning the air since the air temperature will be approximately the average temperature of the two areas separated by the curtain. This return of the air to the plenum can be achieved by providing an adjacent set of ducts, connected to the lower ends of the ducts containing the downward flowing air, for returning the air upward toward the plenum. The upper ends of the return ducts can merely open into one of the adjacent areas, or can be directed outside the structure entirely. Preferably, the upper ends of the return ducts are connected to an intake portion of the header so that the conditioned air is re-circulated in a manner reducing the overall energy demand of the system. The return ducts can be positioned in a variety of patterns and can form an additional layer of each strip forming the curtain.

The return ducts can also be separate from the strips forming the curtain. For example, the return ducts can constitute an open channel in the floor immediately below the lower end of a curtain having open lower ended downward flowing ducts. The channel can then be connected to ducting on one or both sides of the opening in which the curtain is installed, the ducting leading to the plenum where the returned air can be heated and dried as necessary before reintroduction into the header coupled to the upper end of the curtain.

The warming of the air to be introduced into the ducts can be achieved using any convenient heating element and an appropriate source of power. A particularly advantageous mechanism for warming the flow of air is a large area heat exchanger that merely draws heat from the air in the warmer area, or perhaps from air exterior to the structure as a whole. Such an air warming mechanism does not use energy in the warming process itself, although it would still require the use of some energy to move the air through the heat exchanger and down the ducts of the curtain strips. Alternatively, with the aid of a heat pump, it is conceivable that the heat exchanger would be positioned in the cooler area and thereby aid in maintaining the temperature difference between the two areas. Further, the heat pump can be used to heat or dry the air, or both so as to arrive at the desired level of conditioning.

The conditioned air can be sub-divided into two or more flows of air where there are more than two sheets employed to make curtain strips having multiple layers of ducts rather than just a single layer or set of ducts. Where the air is sub-divided into two or more flows, the temperatures of the flows can be varied from each other by providing additional air warmers for the flow adjacent the area having the higher ambient temperature.

One feature of the present invention is a header that can be affixed to or form a part of the top of an opening in a wall between a cooled or refrigerated area and an adjacent area having a significantly higher temperature. The header is intended to support an industrial curtain of the type described herein and includes means for directing a flow of air into the upper end of the plurality of ducts of each of the strips forming such an industrial curtain. The header includes a plenum that preferably draws in air from the cooler area and warms the air in a heater or heat exchanger. The warming of the previously cooled air has the advantage of drying the air thus increasing the capacity of the air to evaporate any moisture that it might encounter.

Another feature of the present invention is the industrial curtain formed from a plurality of strips, each strip comprising at least two sheets of material fixed to each other so as to define a plurality of open-ended ducts extending from the top to the bottom of the curtain. The open ended ducts are intended to be connected to the plenum of the header so that the conditioned air is internally conducted to the bottom of the industrial curtain prior to any interaction with the surrounding air or with any frost or condensation that might have previously formed. This structure has the advantage of locating a flow of conditioned air at the bottom of the industrial curtain so that it can flow by convection up either side of the curtain to remove any condensation present and prevent any further formation of condensation or frost on the curtain.

Other features and advantages of the present invention will become apparent to those skilled in the art from a consideration of the following discussion of preferred embodiments of the invention that are illustrated in the accompanying drawings.

DESCRIPTION OF THE PREFERRED EMBODIMENTS

Figure 1:
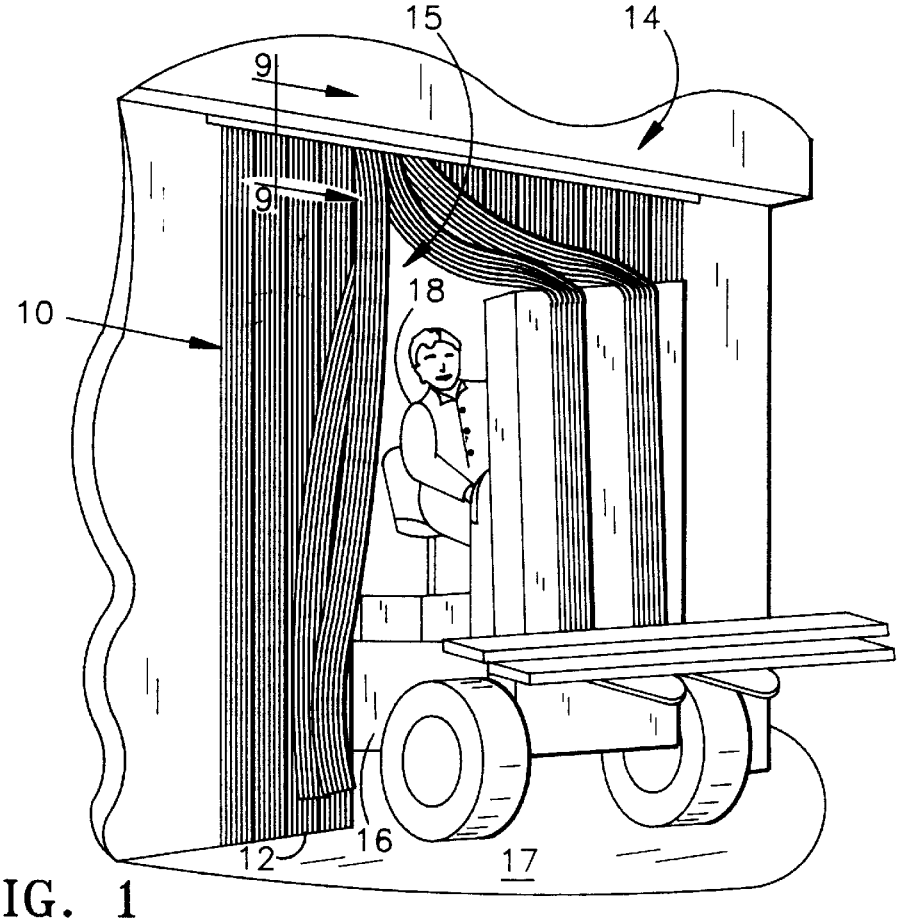
FIG. 1 is a perspective view of an industrial curtain installation in which the present invention is employed.
Figure 2:
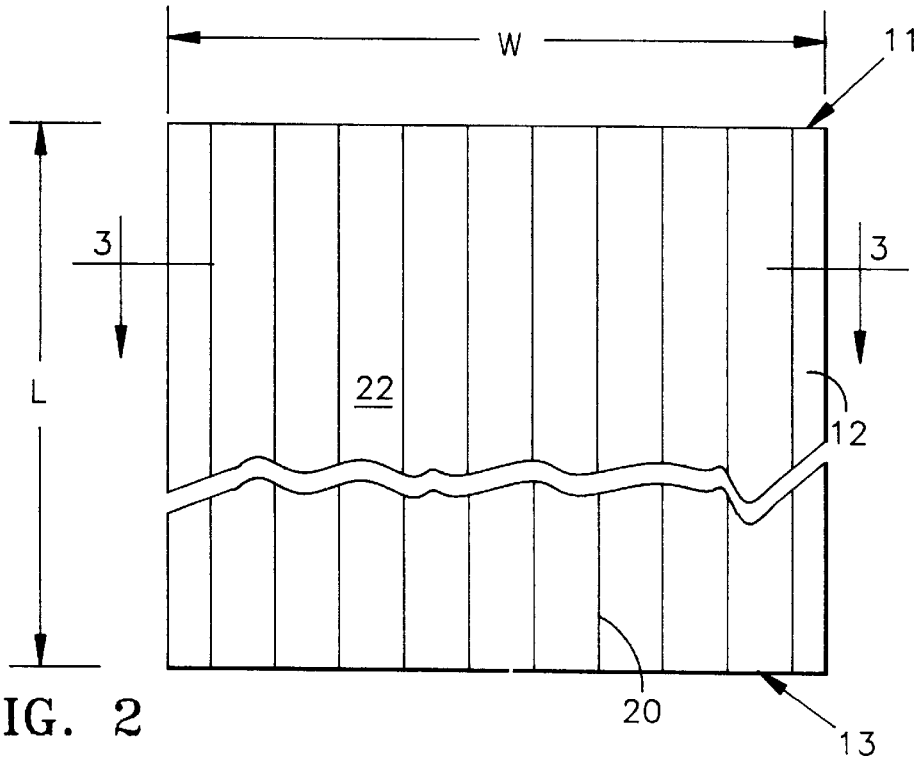
FIG. 2 is a front elevation view of a strip forming the industrial curtain shown in FIG. 1.
Figure 9:
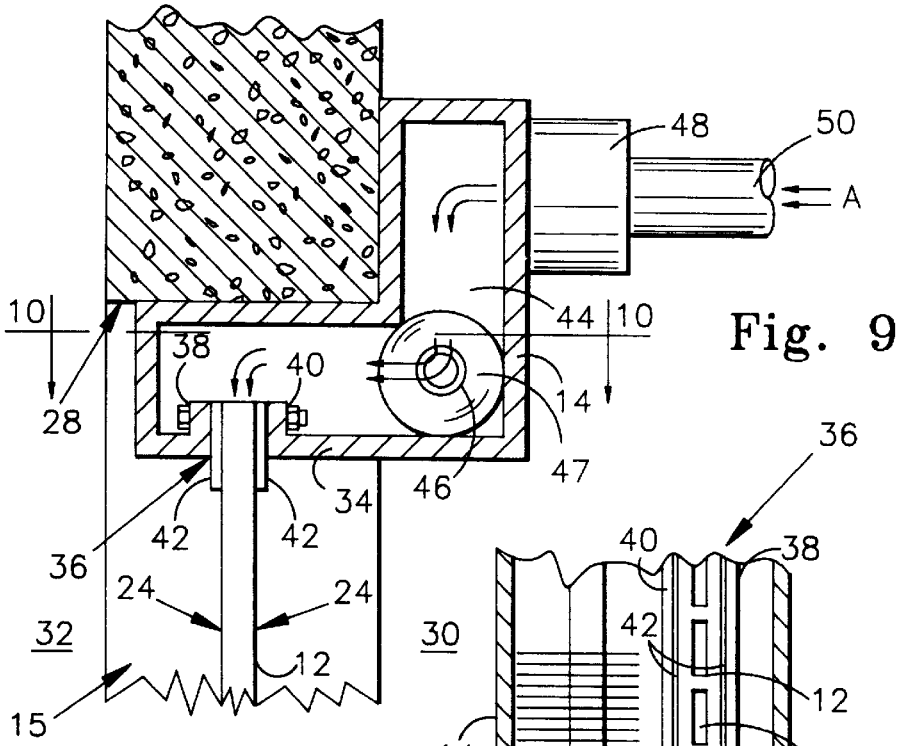
FIG. 9 is a sectional view taken along line 9—9 of FIG. 1 of a header of the present invention.

An industrial traffic curtain 10 comprising a plurality of individual strips 12 in accordance with the present invention is shown installed in a doorway 15 in FIG. 1. The individual strips 12 are suspended by their top or upper end 11 from a header 14 further disclosed in connection with FIGS. 9 and 10. The individual strips 12 consist essentially of a length L, as needed so that the bottom or lower end 13 is positioned adjacent the floor 17. The individual strips 12 are preferably made of a flexible transparent plastic material, such as polyvinyl chloride, having a substantially uniform width W as shown in FIG. 2. The individual strips 12 can have a uniform cross-section as shown and described in connection with any of FIGS. 3 through 7. The width W of the strips 12 can be any dimension, but are typically fixed at two-inch increments between about 6 and 16 inches. A conventional extrusion process can form the strips 12 of plastic material. Alternatively, the strips 12 can be constructed of pre-formed sheets, e.g., corrugated sheets, that are bonded together to for the desired structure. Other alternatives will be apparent from the present disclosure to those skilled in the art. The strips 12 are intended to be sufficiently transparent that an on-coming goods transporting vehicle 16 would be generally visible through the curtain 10. The strips 12 are also intended to be sufficiently transparent that an operator 18 of such a goods transporting vehicle 16 would be able to survey the area on a far side of the curtain 10 before proceeding through the doorway 14. The curtain 10 can include more than one layer of strips 12 in which case the substantially transparent character of the curtain 10 is only slightly reduced.

Figure 3:
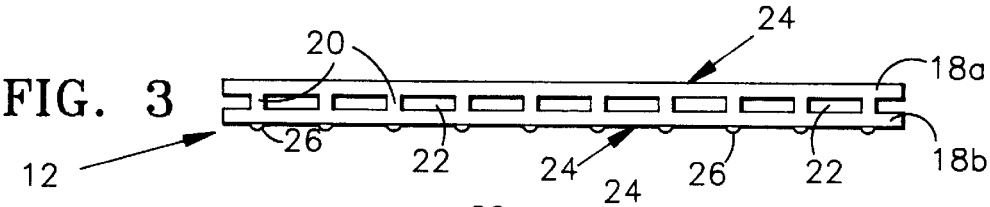
FIG. 3 is a sectional view of the material shown in FIG. 2 taken along line 3—3 showing a the material in lateral cross-section having rectangular ducts.
Figure 4:
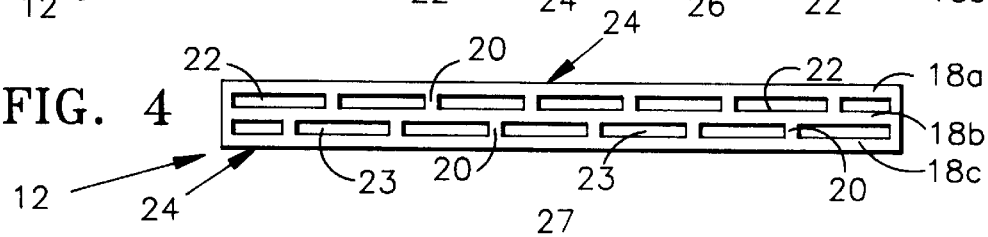
FIG. 4 is a sectional view similar to FIG. 3 of an alternative embodiment of the material forming the industrial curtain with two layers of ducts.
Figure 5:
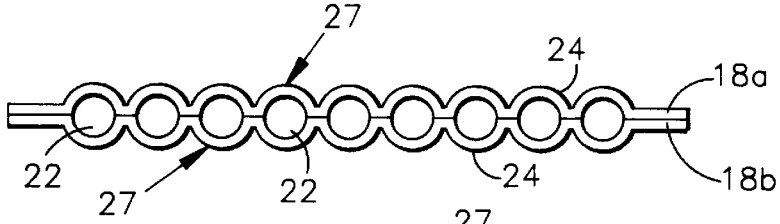
FIG. 5 is a sectional view similar to FIG. 3 of an alternative embodiment of the material forming the industrial curtain with round tubes forming the ducts.
Figure 6:
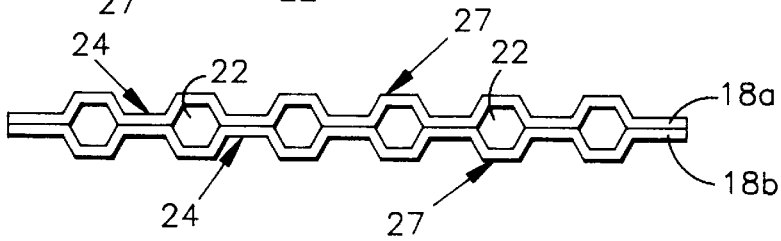
FIG. 6 is a sectional view similar to FIG. 3 of an alternative embodiment of the material forming the industrial curtain with hexagonal ducts.
Figure 7:
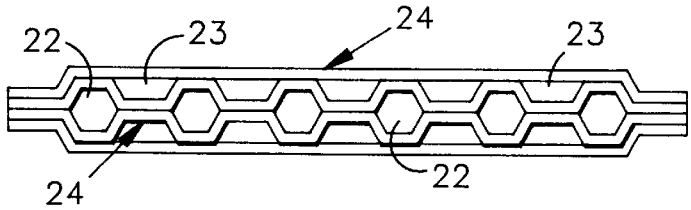
FIG. 7 is a sectional view similar to FIG. 3 of an alternative embodiment of the material forming the industrial curtain with hexagonal ducts in a central portion and smaller trapezoidal ducts on outside portions.
Figure 8:
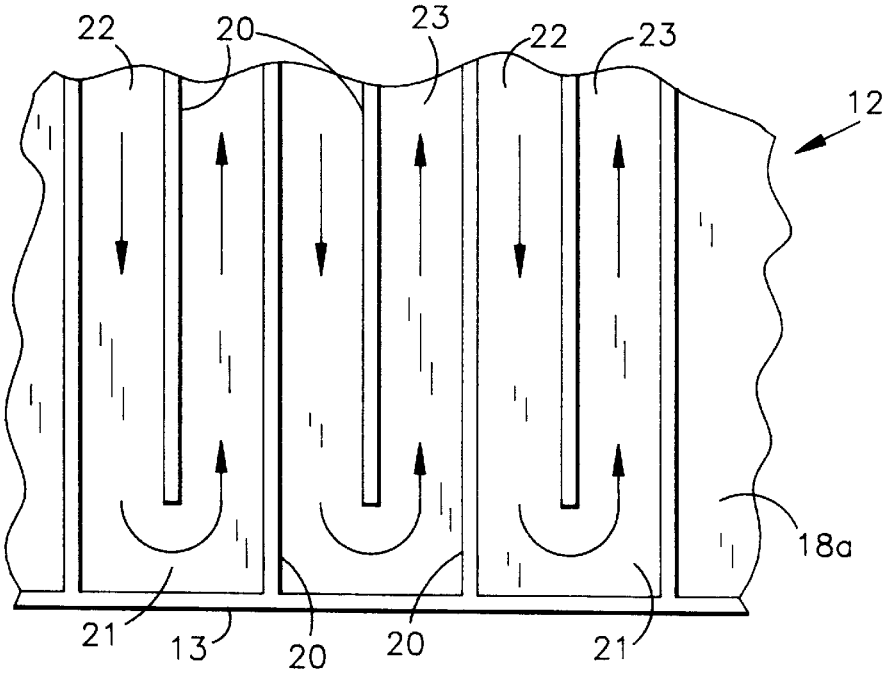
FIG. 8 is a sectional view of a portion of the lower end of a strip having closed end ducts connected to each other to provide a return path for the air.

Each of the strips 12 is formed to have at least two sheets 18*a*, 18*b*, etc., of substantially transparent material. The sheets 18*a*, 18*b*, etc., can be fixed to each other by a series of webs 20 as show in FIGS. 3 and 4 so as to define a plurality of ducts 22 and, in some embodiments, ducts 23. Alternatively, the sheets 18*a*, 18*b*, etc., can be corrugated as shown in FIGS. 5 through 7 and then bonded or welded or cemented to each other form the plurality of ducts 22 and, in some embodiments, ducts 23. The channels 22 generally extend continuously from the upper end 11 to the lower end 13 and the upper and lower ends of the channels 22 are open so that a flow of air can be forced down through the channels. Alternatively, the lower ends of the ducts 22 and 23 and be closed to the outside of the curtain strips 12, but be opened to communicate with each other by connecting ducts 21 as shown in FIG. 8. The outward facing surfaces 24 of the outermost sheets 18 can be smooth so as to maximize visibility through the strips 12 as shown in FIGS. 3, 4 and 7. The outward facing surfaces 24 can also include a series of longitudinal ribs or beads 26 that act to inhibit abrasion of the surfaces 24 by the passing goods transporting vehicle 16 as shown in FIG. 3. The outward facing surfaces 24 can also include a series of longitudinal undulations 27 formed by the corrugations of the sheets 18 that act to inhibit abrasion of the surfaces 24 by the passing goods transporting vehicle 16 as shown in FIGS. 5 and 6. Other variations will be apparent from this disclosure to those skilled in the art.

The header 14 can be fixed to the transom 28 of the doorway so that the strips 12 of the curtain 10 are centrally positioned in the doorway 15 between a refrigerated or colder area 30 and a heated or warmer area 32. The header 14 includes a lower wall 34 having a slot opening 36 defined by edges 38 and 40. Sealing gaskets 42 seal the strips 12 to the edges 38 and 40. The header 14 includes a plenum 44 that contains a heater 46 having fins 47 for maximizing the thermal exchange between the heater 46 and the passing air flow. A blower 48, which includes an inlet opening or pipe 50 preferably located in the refrigerated or cooler area 30, is fixed to the header 14 so as to force a flow of incoming air A past the heater 46 to warm the flow of air. The warmed air flow is directed into and down the channels 22 in the strips 12 to emerge out the bottom 13 of the curtain 10 adjacent the floor 17. The air flowing down the channels is exposed on one side to the temperatures existing in the cooler area 30 and on the opposite side to the temperatures existing in the warmer area 32. As a consequence, the air flowing downward within the channels 22 will generally moderate toward a temperature that is intermediate of that existing in the two areas 30 and 32, although the amount of such moderation depends on the residence time of the air in the channels 22, which is in turn inversely related to the rate of downward flow of the air. Thus the warming by the heater 46 of the air to be introduced into the channels 22 need only be to about that intermediate temperature, but can be warmed further if desired.

Figure 10:
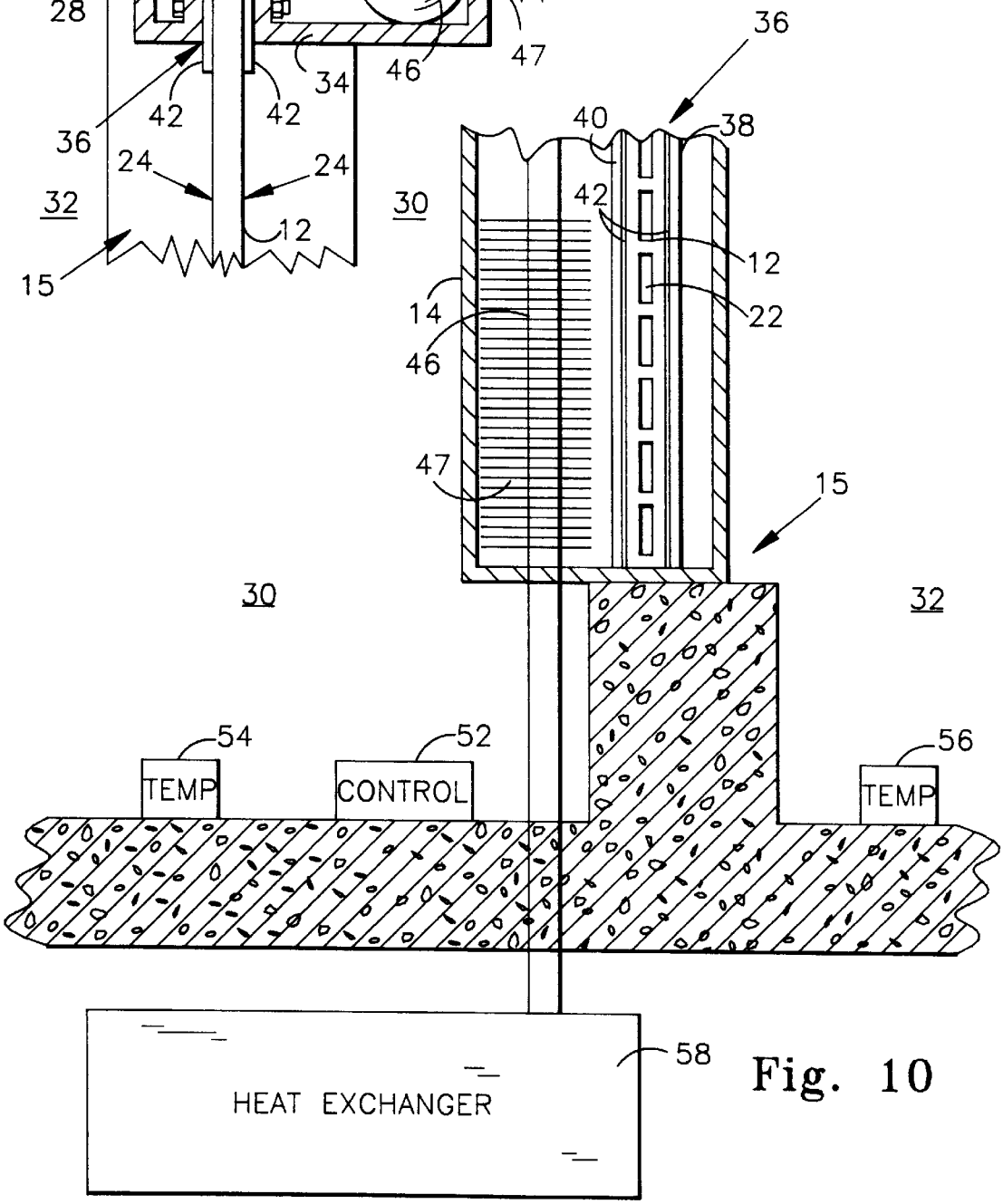
FIG. 10 is a partially schematic sectional view taken along line 10—10 of FIG. 9 of a heated industrial curtain installation according to the present invention.

The heating by heater 46 can be controlled by a control 52 that includes thermostatic inputs 54 and 56 positioned respectively in the cooler and warmer areas, 30 and 32, respectively, as shown in FIG. 10. It will be appreciated that the warming of the air to be introduced into the channels 22 can be achieved using any convenient heating element and an appropriate source of power. The output of the control 52 can be used to control the amount of power supplied to heater 46 from an outside source of power (not shown) such as an electrical outlet for an electrical heater, or a gas or oil line for a combustion heater. Alternatively the control 52 can be used to control the amount of heat pumped from a heat exchanger 58, which is preferably situated on the building exterior, as shown in FIG. 10, but could be positioned in the cooler area and thereby assist in maintaining the temperature difference between the cooler area 30 and the warmer area 32. A particularly advantageous mechanism for warming the flow of air is a large area heat exchanger that merely draws heat from the air in the warmer area 32, or perhaps from air exterior to the structure as a whole. Such a passive air warming mechanism does not use as much energy as a separately fueled heater in the warming process itself, although the passive air warming mechanism would still require the use of some energy to move the air through the heater fins 47 and down the channels 22 of the curtain strips 12.

The intake air A is preferably taken from the colder area 30 since the air in that area, being colder, will generally have less retained moisture. A chiller can be situated in the inlet air flow 50 which is intended to condense any moisture in the intake air A prior to being heated by heater 46 to thereby optimally condition the air prior to being introduced into the channels 22 in the curtain 12. The air is heated to a temperature that preferably is at least about midway between the temperatures of the two areas 30 and 32 separated by the curtain 10. The intake air A can also be dried in other ways that will be apparent from the present disclosure to those skilled in the art to remove unwanted moisture. As the conditioned air proceeds downward through the length of the channels 22, the air preferably is resident in the channels for a sufficiently short period of time so that it does not significantly change its temperature. As a result, the dry warmed air flowing downward through the channels 22 is delivered substantially at floor level immediately below the curtain 10 and generally uniformly across the width of the opening 15 in which the curtain is positioned. The conditioned air in the channels 22 generally maintains the surface 24 of the curtain confronting the warmer area 32 at a higher temperature that would be the case without the downward flow of air, thus inhibiting the formation of condensation or frost on the curtain surface.

In one embodiment of the present invention, the conditioned air emerges from the curtain lower end 13. The emerging warm dry air encounters the floor surface where it can evaporate any existing water or ice and, over time, eliminate any moisture from the floor surface in the vicinity of the curtain. The natural convection currents induced by the warm air at floor level cause the dry warmed air to flow upward on either side of the curtain 10, with the air flow forming a moving blanket that additionally inhibits the formation of condensation or frost on the curtain surface.

In the event that two or more sets of channels are provided in the strips as shown by FIG. 4 and FIG. 7, or if multiple layers of the strips shown in FIG. 3, 5 or 6 are employed, the warmed air can be sub-divided into two or more flows of air where the temperatures of the flows can be varied from each other by providing additional air warmers for the flow adjacent the area having the higher ambient temperature. Alternatively, the lower ends of the ducts 22 and 23 and be closed to the outside of the curtain strips 12, but be opened to communicate with each other by connecting ducts 21 as shown in FIG. 8. The connecting ducts 21 allow the conditioned air to flow down one of the sets of ducts 22 or 23 and to return back toward the header 14 through the other set of ducts 23 or 22, respectively. This return flow stabilizes the temperature of the strip and lowers the amount of thermal treatment that the air flow must undergo to be effective to maintain the curtain substantially free of frost and condensation despite significant differences in environmental temperature on opposite sides of the curtain.

While the forgoing description conveys the best mode of the invention known to the applicant at the time of filing, still other variations of the invention will be apparent to those skilled in the art based on this description of preferred embodiments, which variations are intended to be covered by the following claims.

What is claimed is:

1. An industrial curtain installation comprising: a header, a plurality of substantially transparent strips having upper and lower ends, the upper ends being supported by the header, each strip including at least two layers of substantially transparent material fixed to each other and duct means within each strip provided between the at least two layers and extending from the header to the lower end of each strip for conducting a flow of warmed air downward from the header for heating the strip so that the curtain remains substantially free of frost and condensation despite significant differences in environmental temperature on opposite sides of the curtain.

2. The industrial curtain installation of claim 1 wherein the header further comprises a heater positioned in the header to warm an intake flow of air to produce the flow of warmed air.

3. The industrial curtain installation of claim 2 wherein the header further comprises a blower for forcing the intake flow of air past the heater.

4. The industrial curtain installation of claim 2 further comprising a heat exchanger coupled to the heater and positioned to receive heat from an ambient source for transfer to the intake flow of air within the header.

5. The industrial curtain installation of any of claims 1–4 wherein the duct means comprises a plurality of rectangular channels laterally adjacent to each other between the two layers of substantially transparent material.

6. The industrial curtain installation of any of claims 1–4 wherein the duct means comprises a plurality of tubes connected laterally to each other, an outer surface of the plurality of tubes defining said two layers of substantially transparent material.

7. The industrial curtain installation of any of claims 1–4 further comprising return means enabling the return of said flow of warmed air toward the header.

8. The industrial curtain installation of claim 7 wherein the return means comprises at least one duct in each strip connected to the lower end of said duct means conducting the warmed air downward from the header for returning the warmed air back toward the header.

9. The industrial curtain installation of claim 8 wherein the return means comprises a plurality of return ducts having upper ends connected to an input to the header.

10. A substantially transparent thermal barrier for use in an opening between a refrigerated area and an adjacent area having a significantly higher temperature, the opening having an upper margin defining a header, the barrier comprising:

a plurality of strips having upper and lower ends, the upper ends being supported by the header, each strip including at least two layers of substantially transparent material fixed to each other and including at least one duct extending from the upper end to the lower end of each strip, the header including means for directing a flow of air into the at least one duct in each of the strips.

11. The thermal barrier of claim 10 wherein the at least one duct comprises a plurality of rectangular channels laterally adjacent to each other between the two layers of substantially transparent material.

12. The thermal barrier of claim 11 wherein each of the plurality of strips has a uniform longitudinal cross-section and a transverse cross-section defined by first and second parallel surface sheets, an array of regularly spaced longitudinal ribs joining confronting surfaces of the sheets together in spaced relation to form said plurality of rectangular channels.

13. The thermal barrier of claim 10 wherein the at least one duct comprises a plurality of tubes connected laterally to each other, an outer surface of the plurality of tubes defining said two layers of substantially transparent material.

14. The thermal barrier of any of claims 10–13 wherein each of the sheets forming the plurality of strips comprises outside surfaces that are planar.

15. The thermal barrier of any of claims 10–13 wherein each of the sheets forming the plurality of strips comprise outside surfaces including longitudinal ribs for protecting the outside surfaces from abrasion by industrial traffic passing through the barrier.

16. The thermal barrier of claim 10 wherein the header comprises an intake for receiving air from the refrigerated compartment to form the flow of air.

17. The thermal barrier of claim 16 wherein the return means comprises a plurality of return ducts having upper ends connected to said intake.

18. The thermal barrier of any of claims 10 to 16 wherein the header further comprises a heater for heating the flow of air.

19. The thermal barrier of claim 18 further comprising return means enabling the return of said flow of warmed air toward the header.

20. The thermal barrier of claim 19 wherein the return means comprises at least one return duct in each strip connected to the lower end of said at least one duct for returning the warmed air back toward the header.

21. A strip material for use as an industrial traffic curtain in an opening in a wall between two areas, the curtain generally formed from a plurality of strips suspended adjacent to each other from a header fixed to a top margin of the wall opening, each strip consisting essentially of at least two sheets of substantially transparent material fixed to each other so as to define duct means extending from the upper end to the lower end of each strip for conducting a downward flow of air conditioned so that the curtain remains substantially transparent despite significant differences in environmental temperature on opposite sides of the curtain.

22. The strip material of claim 21 further comprising an array of regularly spaced longitudinal ribs joining confronting surfaces of the at least two sheets together in spaced relation to form a plurality of channels of predetermined dimension having a uniform longitudinal cross-section and a transverse cross-section defining said duct means.

23. The strip material of claim 21 wherein the outermost surfaces defined by said at least two sheets comprises planar outside surfaces.

24. The strip material of claim 22 wherein the outermost surfaces defined by said at least two sheets comprises planar outside surfaces including longitudinal ribs for protecting the outside surfaces from abrasion by industrial traffic passing through the curtain.

25. The strip material of any of claims 21–24 wherein the duct means comprises a plurality of rectangular channels laterally adjacent to each other between the at leas t two layers of substantially transparent material.

26. The strip material of any of claims 21–24 wherein the duct means comprises a plurality of tubes connected laterally to each other, an outer surface of the plurality of tubes defining said at least two layers of substantially transparent material.

27. The strip material of any of claims 21–24 further comprising return means enabling the return of said flow of air toward said strip upper end.

28. The strip material of claim 27 wherein the return means comprises at least one connecting duct in each strip lower end connecting two adjacent duct means.

* * * * *

UNITED STATES PATENT AND TRADEMARK OFFICE

CERTIFICATE OF CORRECTION

PATENT NO. : 6,474,983 B1
DATED : November 5, 2002
INVENTOR(S) : Robbins

It is certified that error appears in the above-identified patent and that said Letters Patent is hereby corrected as shown below:

Title page,
Item [76], Inventor, replace the Inventor's name "Edward S. Robbins" with -- Edward S. Robbins III --.

Column 9,
Line 13, replace the number "22" with -- 21 --.

Column 10,
Line 3, replace the word "leas" and the letter "t" with the word -- least --.

Signed and Sealed this

Eighth Day of April, 2003

JAMES E. ROGAN
*Director of the United States Patent and Trademark Office*